US005092591A

United States Patent [19]

Tol

[11] Patent Number: 5,092,591

[45] Date of Patent: Mar. 3, 1992

[54] THERAPEUTICAL GAME APPARATUS

[76] Inventor: John H. Tol, Hercules Segherslaan 254, 4383 VS Vlissingen, Netherlands

[21] Appl. No.: 550,732

[22] Filed: Jul. 9, 1990

[30] Foreign Application Priority Data

Jul. 10, 1989 [NL] Netherlands ..... 8901764

[51] Int. Cl.[5] ..... A63B 21/012

[52] U.S. Cl. ..... 272/131; 446/1; 434/258

[58] Field of Search ..... 272/76, 131; 446/1, 446/118; 434/247, 258, 259

[56] References Cited

U.S. PATENT DOCUMENTS

| | | | |
|---|---|---|---|
| 1,555,993 | 10/1925 | Larson | 446/1 |
| 2,403,522 | 5/1944 | Goldstein et al. | 434/247 |
| 2,602,263 | 7/1952 | Swirkal | 446/1 |
| 2,774,179 | 12/1956 | Zalkind | 434/258 |
| 2,837,862 | 6/1958 | Cleveland | 446/1 |
| 2,905,474 | 9/1959 | Jahr | 446/118 |
| 4,353,701 | 10/1982 | Greenberg | 434/259 |
| 4,654,989 | 4/1987 | Fleming | 446/118 |
| 4,900,019 | 2/1990 | Shamir | 272/901 |

FOREIGN PATENT DOCUMENTS

| | | | |
|---|---|---|---|
| 0478649 | 11/1951 | Canada | 446/1 |
| 705803 | 5/1941 | Fed. Rep. of Germany . | |
| 0409704 | 11/1909 | France | 446/1 |

*Primary Examiner*—Richard J. Apley
*Assistant Examiner*—L. Thomas
*Attorney, Agent, or Firm*—Wells, St. John & Roberts

[57] ABSTRACT

A therapeutical game apparatus is disclosed including a table-like flat member 1 supported by legs 2. The table-like flat member is provided with aperture 6, 7, 8, 9. These apertures receive cylindrical elements 21 that are moveable axially within the aperture responsive to striking blows delivered by a hammer or other appropriate striking tool. Clamp members are aligned with each aperture and include provisions to enable selective adjustment of clamping forces against the cylindrical elements to resist axial motion of the cylindrical elements through their respective apertures. An indication device may be used with the apparatus to visually indicate the adjusted clamping force applied against an associated one of the cylindrical elements.

12 Claims, 4 Drawing Sheets

10
22
21
26
II
II
8
7
1
14
3
4
5
13
23
24
25
2

THERAPEUTICAL GAME APPARATUS

It is often desired to perform therapeutical exercises in order to enforce the bundles of muscles after having suffered from for example arm or bone fracture. Physiotherapist teach exercises which are conducted in the convalescent process to increase muscle load. Such exercises usually are not very stimulating. It is therefore preferable to have these exercises conducted within the scope of a game program.

It is the object of the invention to provide a therapeutical game apparatus by means of which gamewise forces can be measured as well as therapeutical results. The apparatus is therefore suited to be used as a therapeutical element and also as a game apparatus. It is further the object of the invention to provide an apparatus by means of which therapeutical exercises can be conducted in order to improve the muscle control and/or reactions of the arm and wrist.

This is according to the invention achieved by providing a therapeutical game apparatus comprising a table-like horizontal supporting surface, adjustable clamping means applied on said surface to clamp vertically, cylindrical elements having a head, and a stroke device.

According to the invention the user should, by applying strokes by means of the stroke device on the head, move down vertically the cylindrical element. In dependence of the skill and in case of a therapeutical use, the progress of the convalescent process, the load can be increased by means of the adjustable clamping means. As there are a plurality of elements which are individually adjustable, the apparatus can be used by groups of persons, which enhances the game element.

The clamping means comprise spaced blocks of flexible material, for example rubber. The passage between the rubber blocks is adjustable by means of an adjusting nut which displaces the blocks with respect to each other.

It is preferred that the table-like surface is comprised of spaced parallel plates and it is preferred that at least a number of the clamping means are mounted in between the plates.

Further clamping means are applied to the lower plate. The upper side of the upper plate can be provided with a covering plate of metal. The spacing between the plates is determined by a spacer provided with sidewise notches.

It is possible to couple an indication device to the adjusting means. Such an indication device indicates the value of the load, in order to have a control means for the referee in case of a game program or the therapist in case of the use as therapeutical apparatus.

The invention will be elucidated with the help of the drawings of a preferred embodiment.

Figure 3:
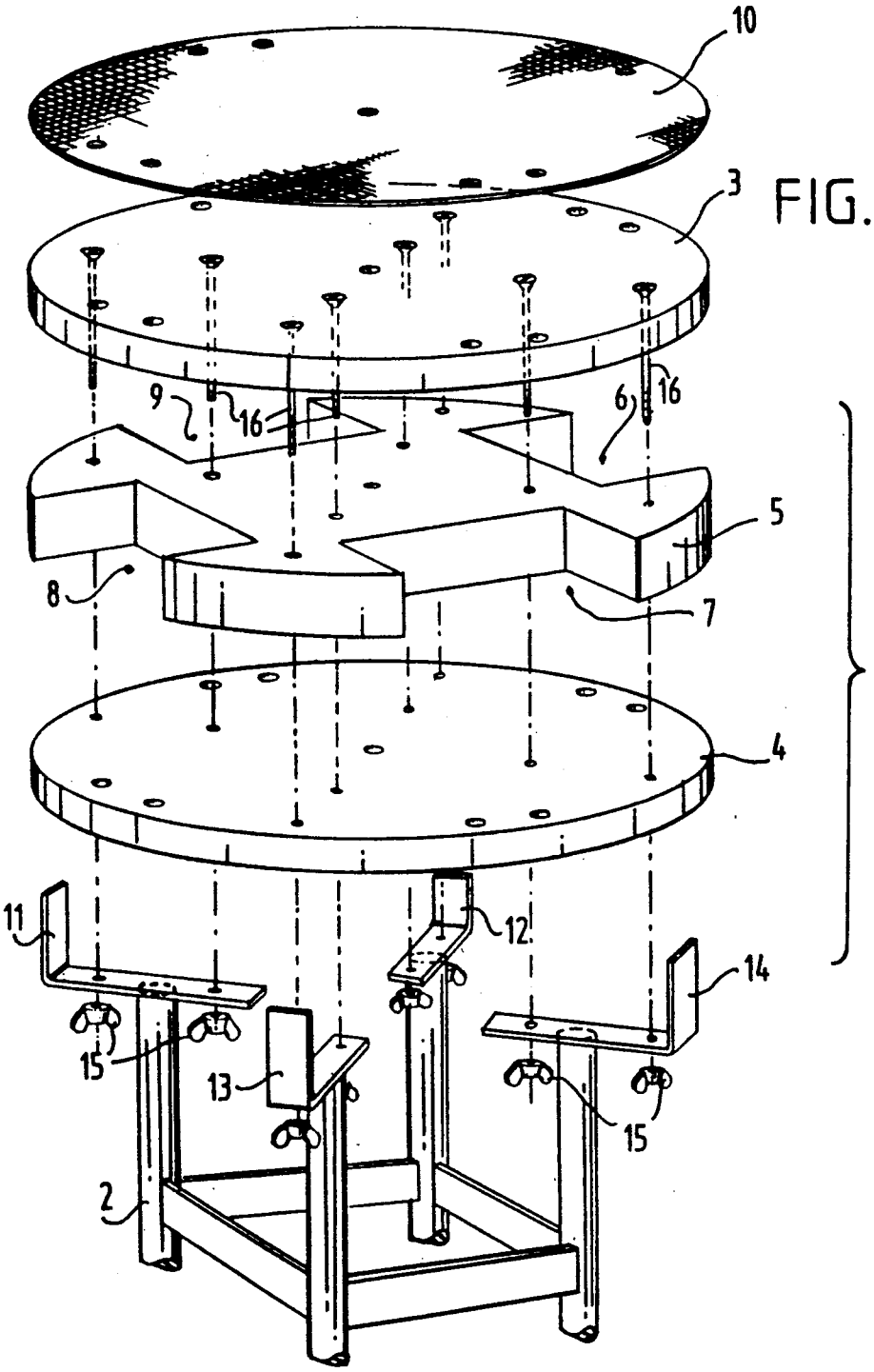
FIG. 3 is an exploded view of the device of FIG. 1.

The therapeutical game apparatus comprises an assembled table-like flat member 1 supported by legs 2. The table-like flat member 1 has an upper plate 3 and a lower plate 4. The plates 3 and 4 are spaced by means of a spacer 5, provided with apertures 6, 7, 8, 9 (viz. FIG. 3). The upper surface of the upper plate 3 is covered by a protective rubber lining 10. The plates 3 and 4 and the spacer 5 are coupled to each other by means of brackets 11, 12, 13 and 14 and by means of butterfly nuts 15 and screws 16. Adjustable clamps are applied into the apertures of the spacer 5. The clamps are identical to each other. The clamps consist each of two spaced rubber blocks 17, 18, the distance between the blocks being adjustable with the help of the adjusting screw 19 and the butterfly nut 20. Cylindrical elements in the form of Metal pins, 21, having a head 22, are inserted into the apertures.

Figure 1:
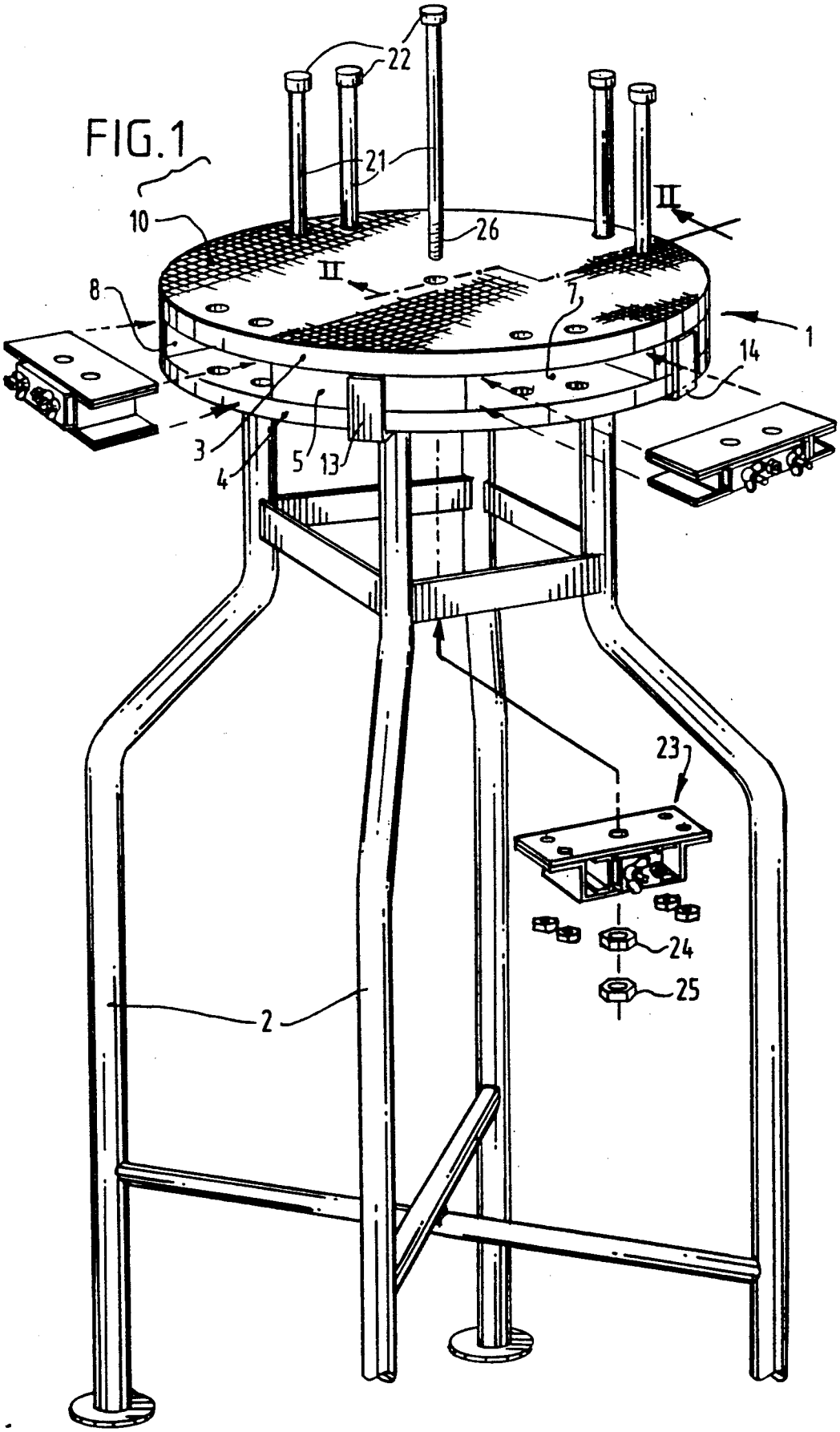
FIG. 1 is an isometric view of an embodiment of the invention.
Figure 2:
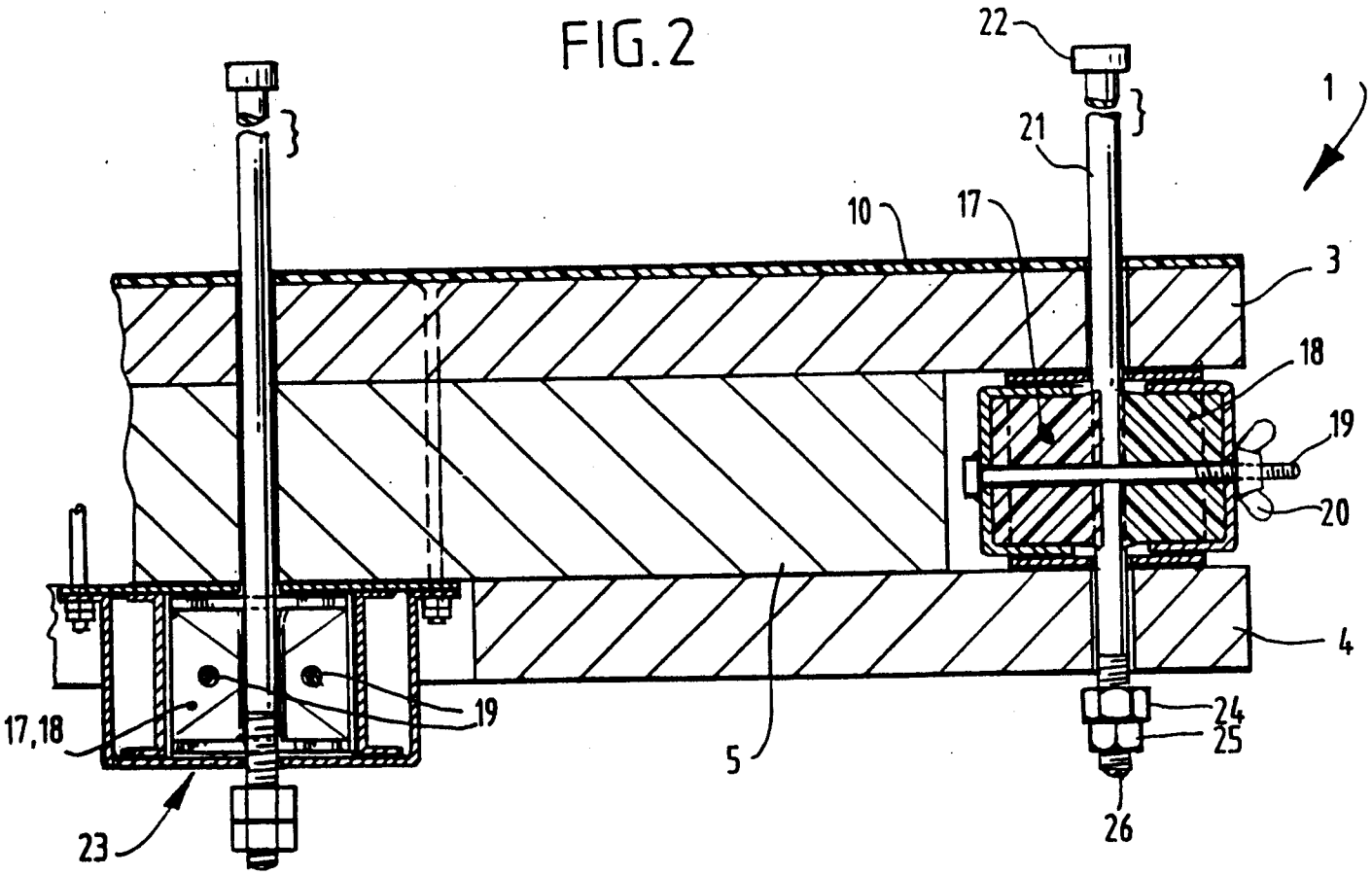
FIG. 2 is a cross section according to the line II—II in FIG. 1.

As shown in FIG. 2, a clamp member 23 is mounted at the underside of the lower plate 4. A cylindrical element 21 is provided at the underside with a pair of adjusting nuts 24, 25 screwed at a threaded part 26 of said cylindrical element. By means of this, the game length, that is the height of the cylindrical element can be adjusted.

As stroke device a hammer (not shown) can be used.

Figure 4:
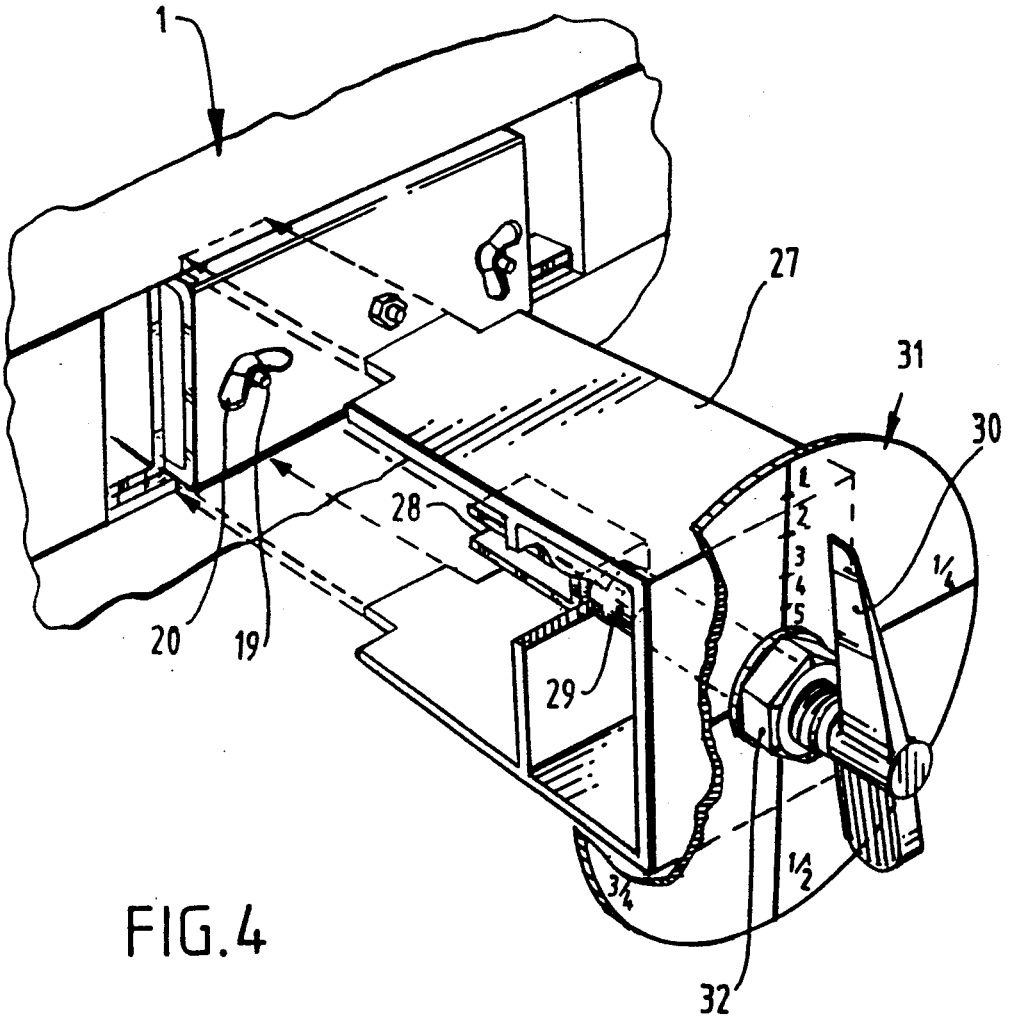
FIG. 4 is an isometric view of an indication device according to the invention.

FIG. 4 shows an indication device to be used with the apparatus according to the invention. The indication device 27 has as object to visually indicate the adjusted clamp force.

The device 27 consists of a rotatable shaft 29 to which is coupled a bifurcated element 28. The bifurcated element 28 engages the butterfly nut 20 such that by rotation of the shaft 29 by means of the actuating member 30 the butterfly nut can be rotated, adjusting the clamping force. By means of a nut 32 a reference disc 31 is mounted on the device 27. The reference disc 31 bears a scale division. The position of the actuating member 30 in relation to disc 31 and hence to the scale division thereon indicates the position of the butterfly nut 20 and therefore the value of the adjusted clamping force.

I claim:

1. A therapeutical game apparatus comprising:

a table like surface;

an aperture formed through said surface;

a cylindrical element disposed within said aperture; and an adjustable clamping means to apply resistive forces against the cylindrical element to resistively hold the cylindrical element in an axial position, whereby resistive force provided by the clamping means opposes movement of the cylindrical element through the aperture in response to a users strike axially against the element.

2. Apparatus according to claim 1, characterized in that, the clamping means is comprised spaced blocks of flexible material.

3. Apparatus according to claim 2, characterized in that the passage between the blocks is adjustable by means of an adjusting nut which displaces the blocks with respect to each other.

4. Apparatus according to claim 1, characterized in that the table-like surface is comprised of spaced parallel plates and that the clamping means is mounted in between the plates.

5. Apparatus according to claim 4, characterized in that clamping means are further applied to the lower plate.

6. Apparatus according to claim 4, characterized in that an upper side of the upper plate is provided with a covering plate of rubber.

7. Apparatus according to claim 4, characterized in that the spacing between the plates is determined by a spacer provided with sidewise notches.

8. Apparatus according to claim 1, characterized in that an indication device is coupled to the adjusting means.

9. Apparatus according to claim 8, wherein the indication device is provided with an adjusting member controlling the clamping means and being coupled with the clamping means;

and a reference member for providing a reference for the position of the adjusting member.

10. Device as claimed in claim 9, characterized in that the reference member is a circular disc with scale divisions thereon.

11. Device as claimed in claim 9, characterized in that the adjusting member is a bifurcated element connected to a rotatable shaft.

12. A therapeutical game apparatus comprising:

a support;

an aperture formed through said support;

an elongated headed pin disposed within said aperture; and an adjustable clamping means on the support to resistively hold said pin in position along the axis thereof, whereby resistive force provided by the clamping means opposes axial movement of the pin through the aperture in response to a users strike axially against the element.

* * * * *